US005529519A

United States Patent [19]

Nakamura et al.

[11] Patent Number: 5,529,519

[45] Date of Patent: Jun. 25, 1996

[54] HYDRAULIC POWER TILT AND TRIM DEVICE

[75] Inventors: Daisuke Nakamura, Hamamatsu; Masahiko Iida, Kakegawa, both of Japan

[73] Assignee: Sanshin Kogyo Kabushiki Kaisha, Hamamatsu, Japan

[21] Appl. No.: 304,947

[22] Filed: Sep. 13, 1994

[30] Foreign Application Priority Data

Sep. 13, 1993 [JP] Japan ..... 5-227497
Sep. 13, 1993 [JP] Japan ..... 5-227498

[51] Int. Cl.[6] ..... B63H 21/26

[52] U.S. Cl. ..... 440/061; 92/23

[58] Field of Search ..... 440/53, 61, 900; 92/22, 23, 65, 165 R, 51–53

[56] References Cited

U.S. PATENT DOCUMENTS 3,982,648 9/1976 Luedtke et al. ..... 92/23
4,929,202 5/1990 Tengelitch ..... 92/23
5,195,914 3/1993 Binversie et al. ..... 440/61

FOREIGN PATENT DOCUMENTS 53992 5/1981 Japan ..... 440/61
1560841 4/1990 U.S.S.R. ..... 92/23

*Primary Examiner*—Edwin L. Swinehart
*Attorney, Agent, or Firm*—Knobbe, Martens, Olson & Bear

[57] ABSTRACT

A telescopic tilt and trim arrangement for an outboard drive that has a compact configuration made possible by positioning the seal between the trim cylinder and the outer cylinder at the upper end of the trim cylinder. In addition, a latching arrangement is incorporated between the trim cylinder and the outer housing for holding the trim cylinder in its fully trimmed up condition when the outboard drive is tilted up.

23 Claims, 8 Drawing Sheets

HYDRAULIC POWER TILT AND TRIM DEVICE

BACKGROUND OF THE INVENTION

This invention relates to an improved hydraulic power tilt and trim device and more particularly to an improved tilt and trim device for an outboard drive.

It is generally the practice in marine outboard propulsion units such as outboard motors or the outboard drive portion of an inboard/outboard drive to provide a hydraulic cylinder assembly that is interposed between the outboard drive and the transom of the associated watercraft. This cylinder assembly can be pressurized by a pressure source for effecting not only trim adjustment but also for tiling the outboard drive up out of the water when not in use. In addition to these purposes, the cylinder includes a damping mechanism so that once in a trim adjusted position and if an underwater obstacle is struck, the outboard drive is permitted to pop up to clear the underwater object and then return to its trim adjusted position once the underwater obstacle has been cleared.

As is well known, the trim adjustment of the outboard drive is normally made when the watercraft is traveling in a forward mode and frequently at high speeds and/or high propulsion thrust. Hence, the hydraulic cylinder must be capable of providing large forces. Tilt-up operation of the outboard drive is, however, normally done when stationary and the amount of force required to effect the tilt-up motion is substantially less than when adjusting trim under power. Also, it is desirable to achieve the tilt-up motion in such a manner at more rapid rate than the trim adjustment.

Therefore, devices have been proposed that include a tilt cylinder that performs the tilt-up operation and a separate trim cylinder for achieving the trim operation. Frequently, there may be provided a pair of trim cylinders and a single tilt cylinder for a total of three cylinders. Obviously, these devices become quite complicated and complex.

In addition, there is the necessity of providing and driving electric motor, a fluid pump and a fluid reservoir for supplying the hydraulic fluid to the cylinders.

There are a number of advantages, particularly with small displacement engines to have a compact nature a compact construction that can be nested between the clamping bracket and the swivel bracket. However, when this is done, the position of the components is such with the prior art type of constructions that the cross-sectional area of the trim cylinder is adversely effected.

In order to improve the compactness of the arrangement, there have been proposed telescopic tilt and trim devices wherein the outer cylinder housing defines a cavity in which a hollow trim cylinder is supported for reciprocation. A tilt piston is slidably supported within the trim cylinder and has a piston rod that is connected to one of the outboard drive or watercraft with the outer cylinder being connected to the other. With these types of arrangements, it has been the practice to have the seal for the trim cylinder and hence its effective area being disposed at the lower portion of the cylinder. However, this is normally adjacent where the fluid pump and fluid reservoir are and this limits the maximum effective diameter due to the aforenoted spatial requirements.

It is, therefore, a principal object of this invention to provide a tilt and trim cylinder that can have a large effective area and yet still provide a compact assembly.

It is a further object of this invention to provide an improved compact tilt and trim arrangement for an outboard drive.

The problems with the prior art type of construction can be best understood by reference to FIGS. 1 and 2–6. FIG. 1 is a cross-sectional view taken through a prior art type of construction, which is indicated generally by reference numeral 21. FIGS. 2–6 are schematic cross-sectional views showing the operation of the unit from the fully trimmed tilted down position of FIG. 2 to the fully trimmed up position of FIG. 4 and finally to the fully tilted up position of FIG. 6.

The construction of the arrangement will be described first by reference to FIG. 1 in which it can be seen that the device 21 includes a cylinder assembly 22 that is provided with a cylinder bore 23. This cylinder bore 23 defines an internal chamber 24 that is closed at its lower end by an integral wall and which is closed at its upper end by a combined end closure and gland 25. The cylinder assembly 22 is adapted to be connected to either of the outboard drive or the transom. In the illustrated arrangement the cylinder is attached to the transom in a manner which will be later described in conjunction with the description of the preferred embodiment of FIG. 7. To this end, the cylinder is provided with a trunnion 26 that defines a bore 27 to receive a pivot pin for pivotal connection to the transom.

A trim cylinder, indicated generally by the reference numeral 28 is slidably supported within the cavity 24 and has an internal bore 29. The trim cylinder 28 has on its outer periphery a cylindrical groove 31 formed at its lower end that receives an O-ring seal 32 so as to effect sealing with the cylinder bore 23 of the outer cylinder assembly 22.

A piston 33 is slidably supported within the cylinder bore 29 of the trim cylinder. This piston 34 is affixed to a piston rod 31 that extends through the gland 25 and has a trunnion 35 at its upper end. The trunnion 35 affords a means of attachment to the other of the transom and outboard drive and in the illustrated embodiment this attachment is to the outboard drive. A bore 37 extends through the trunnion 35 to receive a pivot pin for this connection.

A combined gland and closure member 38 is suitably affixed to the upper end of the trim cylinder 28 and through which the piston rod 34 extends. This closure 38 carries a position responsive valve 39 which functions in a manner to be described.

Positioned within the cylinder bore 29 of the trim cylinder 28 below the piston 35 is a floating piston 41. The floating piston is held in a lowermost position by means of a snap ring 40 that is contained in a groove at the lower end of the trim cylinder 28.

A shock absorber valve 42 is provided in the piston 33 for permitting flow from a chamber 43 formed above the tilt piston 33 and the cylinder bore 29 to a chamber 44 formed therebelow which chamber is defined by the upper surface of the floating piston 41. Fluid flows in this direction, in the manner to be described, when an underwater obstacle is struck.

Once the underwater obstacle is cleared, the tilt piston 33 can move back to its trim adjusted position by displacing fluid from the chamber 44 back to the chamber 43 through a let-down check valve 45 also positioned in the piston 33.

The hydraulic tilt and trim control is provided by pressurizing the chamber 24 below the trim cylinder 28 and floating piston 41 or exhausting this area to return through a passage 46 formed in the cylinder 22 at the lower end of the cylinder bore 23. A further passage 48 is formed at the upper end of the cylinder bore 23 and communicates with an area above the trim cylinder 28 adjacent the gland enclosure 25. This communicates with the chamber indicated by the reference numeral 47. The ports 46 and 48 may be pressurized or vented with the flow occurring in the direction of the double-headed arrows 49 in FIG. 1.

As should be readily apparent, the fact that the O-ring seal 32 is provided at the bottom of the trim cylinder 38 and thus determines its maximum diameter limits the overall diameter of the assembly. As will become apparent by reference to FIGS. 8 and 9 of the preferred embodiment, this is the area adjacent the reservoir and fluid pump and this limits the effective force that can be exerted for trimming operation.

In addition to the aforenoted advantages, because the seal between the trim cylinder and the outer cylinder housing is at the lower end of this housing, then a long tool and intricate machining operation is required. Since it is desirable to maintain close tolerances in this area, this difficulty in machining gives rise to added costs for the prior art type of constructions.

The operation will now be described by particular reference to the FIGS. 2–6 of the drawings. FIG. 2 shows the condition when the outboard drive is in its fully trimmed fully tilted down position. In this condition, the trim cylinder 28 is at the bottom of the cylinder bore 23 and the tilt piston 23 is engaged with the floating piston 41 which is at its lowermost position as determined by the position of the snap ring 40.

If it is desired to effect trim-up operation, the hydraulic circuitry associated with the system is operated so as to pressurize the chamber 24 through the port 46 and open the port 48 to act as a return port. This hydraulic pressure in the chamber 24 will act on the floating piston 41 and trim cylinder 28 so as to cause the floating piston 41, piston 33, and piston rod 34 to move upwardly, as shown in FIG. 3. This will effect a trim operation on the outboard drive. Also, since the effective cross-sectional area of the trim-up portion of the piston operation is relatively large, there will be a high trim-up force and relatively large displacement of fluid in order to achieve this operation at a relatively low speed. This is done because the system operates against the driving thrust of the propulsion unit under most trim adjustment positions.

The trim adjustment can be stopped in any position, and when this is done, for example, if it is discontinued at the position shown in FIG. 3, this will be the new trim adjusted position. In this condition, if an underwater obstacle is struck with sufficient force, the piston rod 34 will be drawn upwardly and the absorber valve 42 will open so that fluid can flow from the chamber 43 through the piston 33 to the area between the piston 33 and the floating piston 41. When the underwater obstacle is cleared, the weight of the outboard drive will cause pressure on the piston 33 to move downwardly, and the fluid can return to the chamber 43 through the light let-down valve 45, as is well known in this art.

FIG. 4 shows the operation necessary to achieve complete trim up, and under this condition the trim cylinder 28 will move to the position shown in FIG. 4, at which time the position responsive valve 39 will be opened. This is necessary to achieve final tilt-up operation if this is desired.

FIGS. 5 and 6 show how tilt-up operation is achieved, and this is done by continuing to pressurize the chamber 24 below the trim cylinder 28. Since the trim cylinder 28 is at the end of its stroke, the fluid pressure will act in the cylinder bore 23 of the trim cylinder 28 and on the floating piston 41, which will be forced into abutting relationship with the piston 33 and move the piston rod 34 and outboard drive unit upwardly. When this happens, fluid is displaced through the position responsive valve 39 and port 48 back to the suction side of the pump. Since the floating piston 41 has less effective area than the trim piston 28, this tilt-up operation will be at a higher rate of speed but will be done with less force. However, since the driving thrust need not be resisted, this presents no problem.

FIG. 6 shows the fully tilted up position, and in this position it should be noted that the piston 33 bottoms against the closure at the end of the trim cylinder 28.

A disadvantage of this construction is that the position responsive valve 39 will be retained in the open position, and hence, the pressure in the upper chamber 47 may exceed the pressure in the lower chamber 24, and a force will be applied due to the weight of the outboard motor that can overcome the frictional drag of the O-ring seal 32 (FIG. 1) and cause the arrangement to drift downwardly. This same action may occur when operating in reverse mode or when maintenance work is made on the lower unit with the lower case removed or when disassembled in the factory. Said another way, it is desirable to retain the trim piston 28 in its fully up position as shown in FIG. 6 in many instances, and the prior art constructions simply do not make this possible.

It is, therefore, a still further object of this invention to provide an improved tilt and trim hydraulic device wherein an arrangement is provided for releasably locking the trim cylinder in its trimmed up position.

It is a further object of this invention to provide an improved automatically operated trim-up lock for the hydraulic power tilt and trim device of an outboard drive.

In addition to the aforenoted advantages, because the seal between the trim cylinder and the outer cylinder housing is at the lower end of this housing, then a long tool and intricate machining operation is required. Since it is desirable to maintain close tolerances in this area, this difficulty in machining gives rise to added costs for the prior art type of constructions.

It is, therefore, a still further object of this invention to provide an improved tilt and trim cylinder arrangement wherein the closely machined surfaces can be easily formed.

SUMMARY OF THE INVENTION

The features of this invention are adapted to be embodied in a telescopic tilt and trim hydraulic cylinder arrangement for an outboard drive and watercraft which is comprised of an outer cylinder element adapted to be affixed to one of the outboard drive and the watercraft and which defines a first internal cavity. A trim cylinder is received within and slidably supported within the first cavity and itself defines a second internal cavity. A tilt piston is slidably received in the second internal cavity and is affixed to a piston rod that extends beyond the internal cavities for attachment to the other of the outboard drive and watercraft. Means are provided for selectively pressurizing the cavities for effecting reciprocal movement of the trim cylinder and tilt piston for effecting trim adjustment of the outboard drive and for effecting reciprocal movement of the tilt piston relative to the trim cylinder for effecting tilt-up operation of the outboard drive.

In accordance with a first feature of the invention, the upper portion of the trim cylinder carries a seal that is engaged with and seals the first internal cavity to define the upper and lower cylinders for effecting the hydraulic operation so as to maintain a relatively large diameter but also permit a compact assembly.

In accordance with another feature of the invention, means are provided for releasably restraining the trim cylinder in position so as to preclude movement of the trim cylinder when in the tilted up position.

BRIEF DESCRIPTION OF THE DRAWINGS

Prior Art Figures

The Invention

Figure 7:
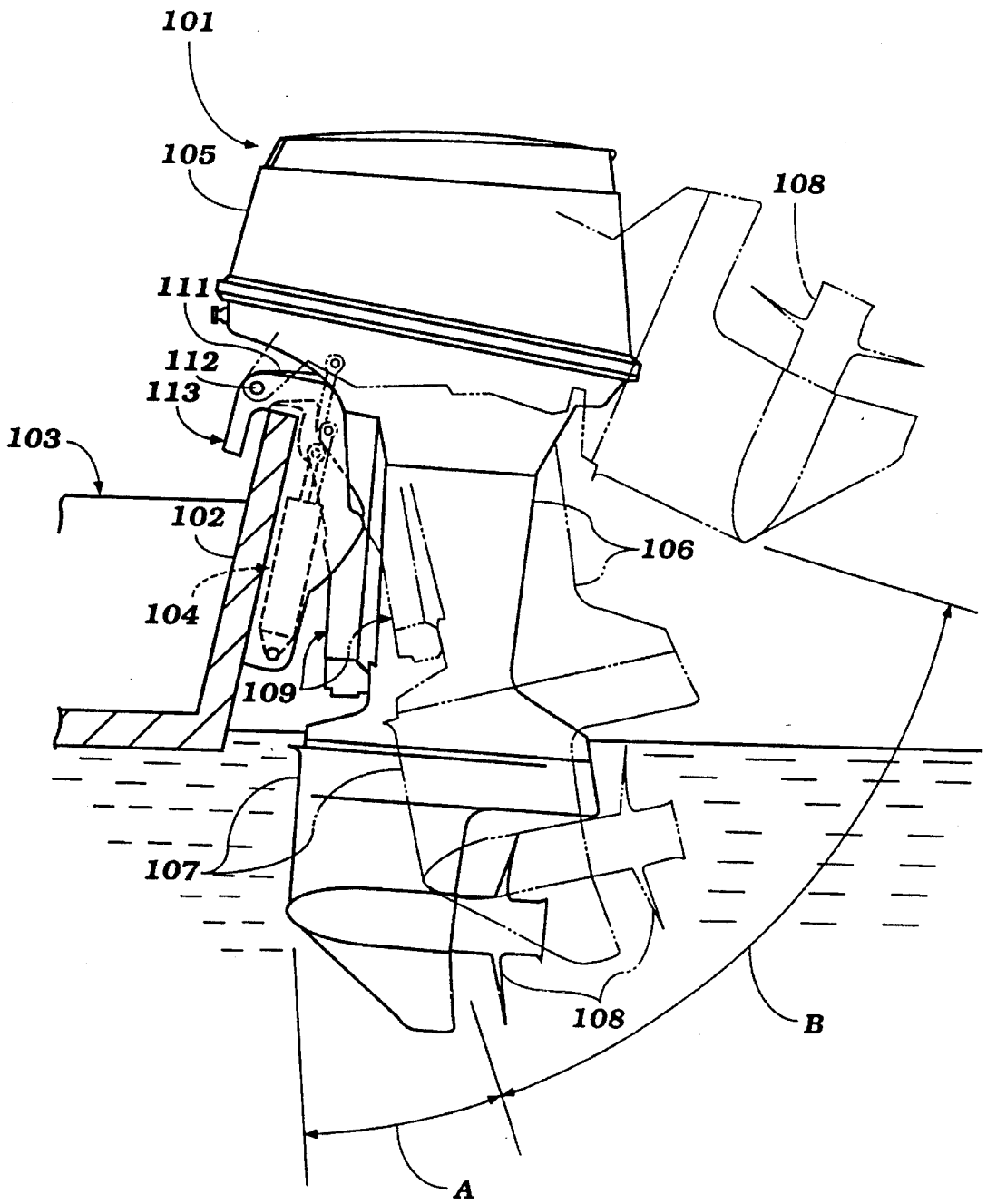

FIG. 7 is a side elevational view of an outboard motor constructed in accordance with an embodiment of the invention as attached to the transom of an associated watercraft, shown partially and in section, and shows the fully trimmed down condition in solid line positions, the fully trimmed up position and the tilted up out-of-the-water position in phantom.

Figure 8:
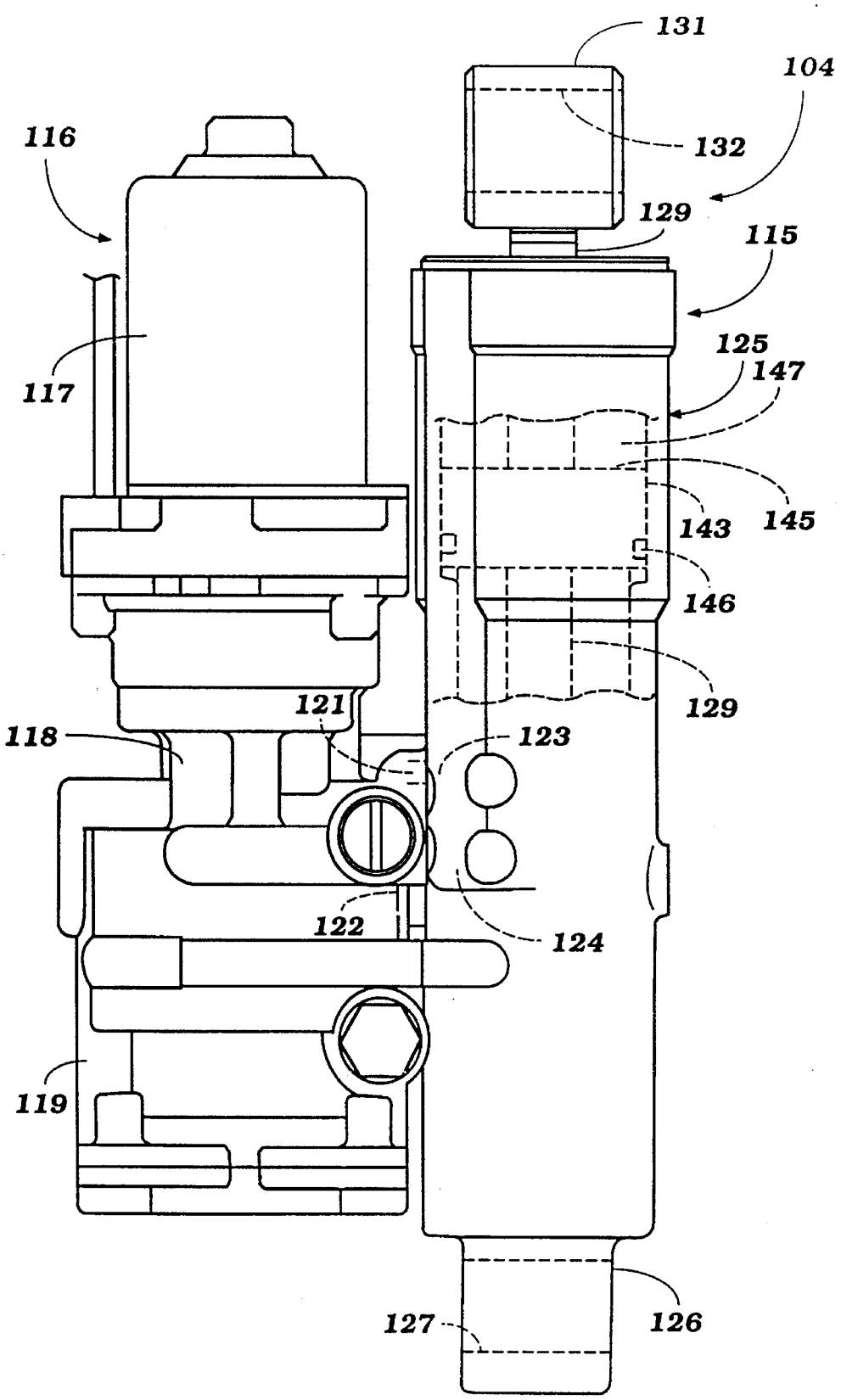

FIG. 8 is an enlarged rear elevational view of the hydraulic tilt and trim adjustment mechanism.

Figure 9:
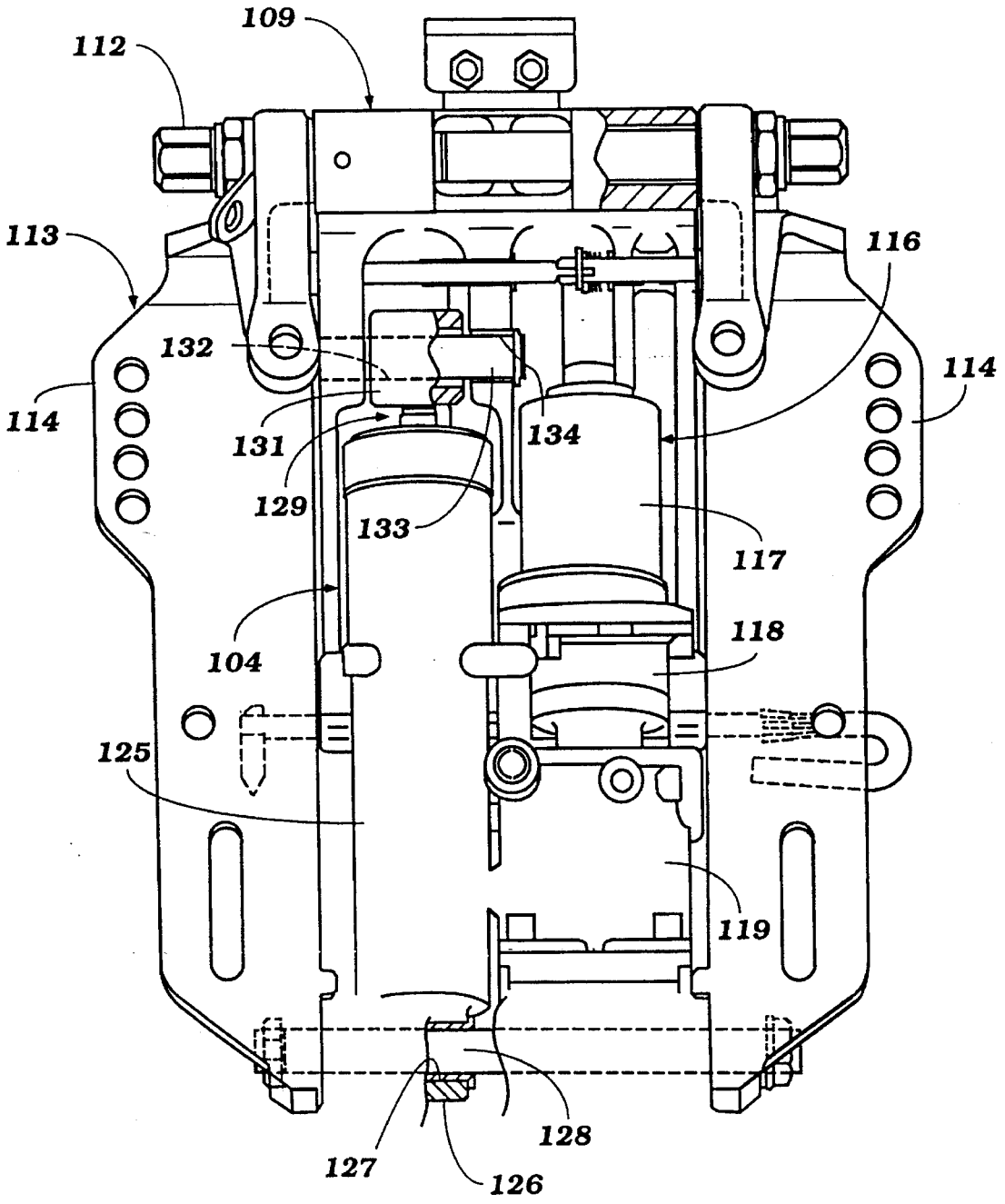

FIG. 9 is an elevational view looking in the opposite direction from FIG. 8 but shows the unit attached to the clamping bracket and outboard motor.

Figure 1:
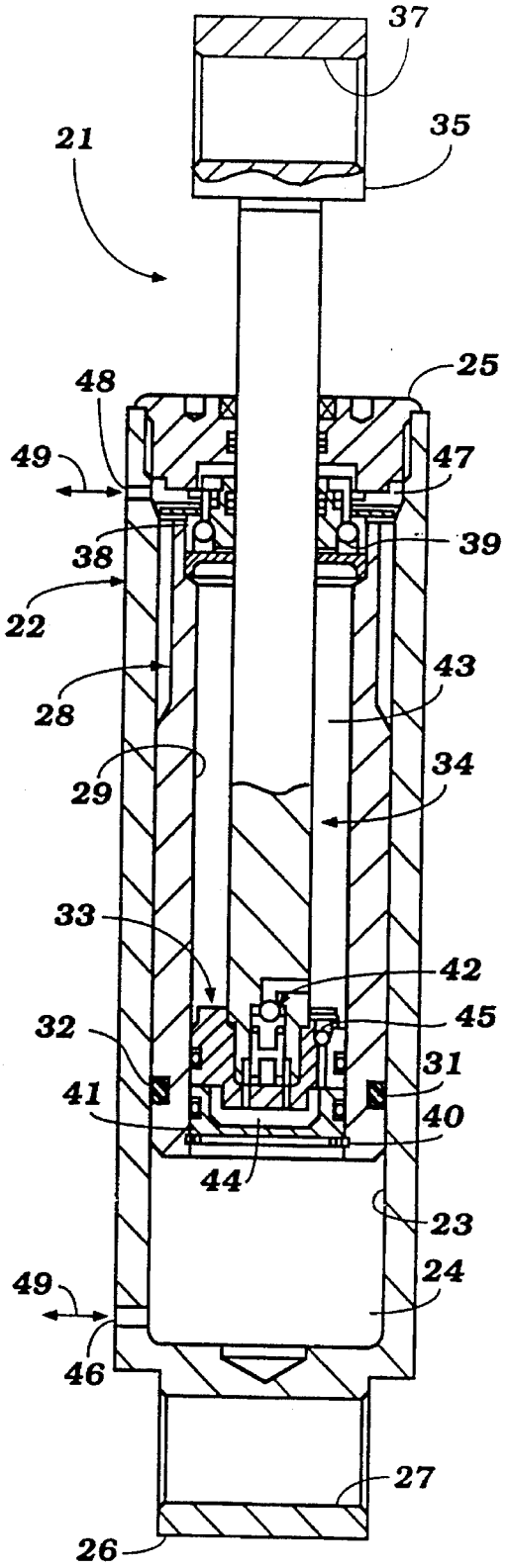
Figure 1 Prior Art
FIG. 1 is a cross-sectional view of a prior art type of construction.
Figure 10:
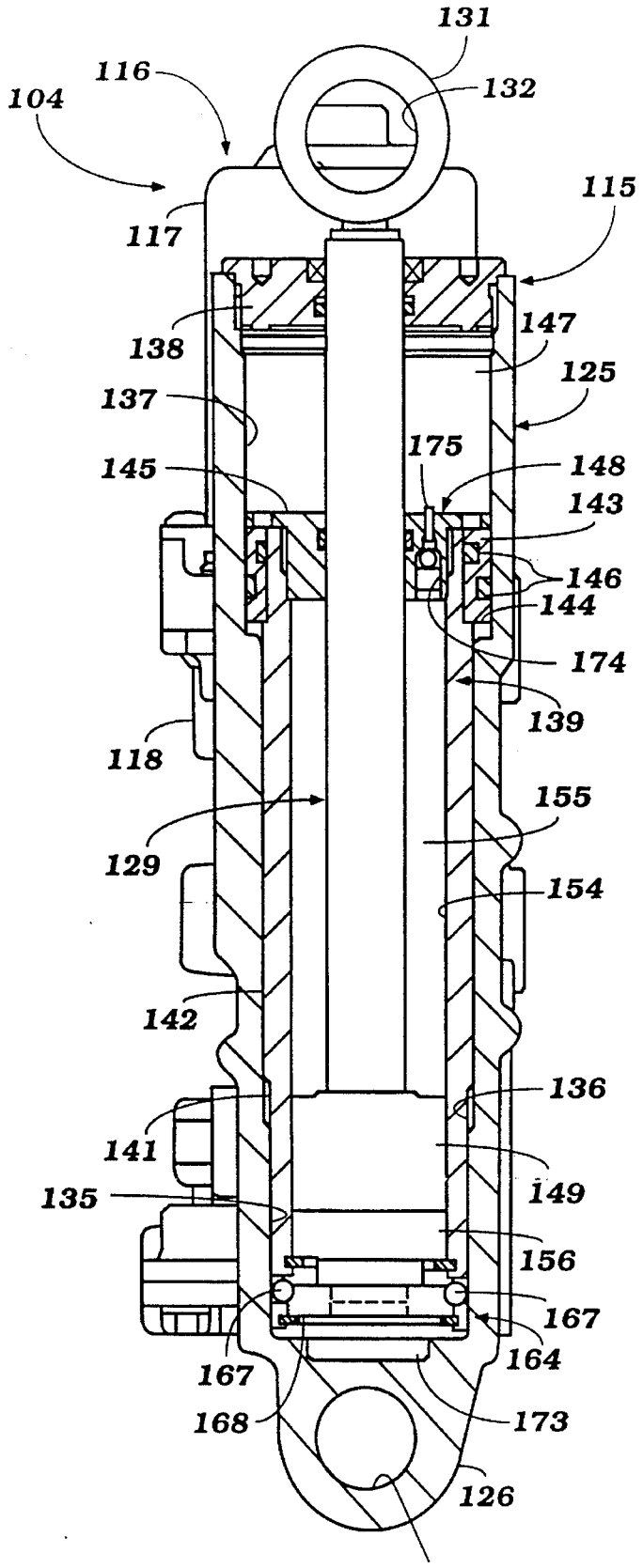

FIG. 10 is a cross-sectional view, in part similar to FIG. 1, and shows the embodiment of the invention.

Figure 11:
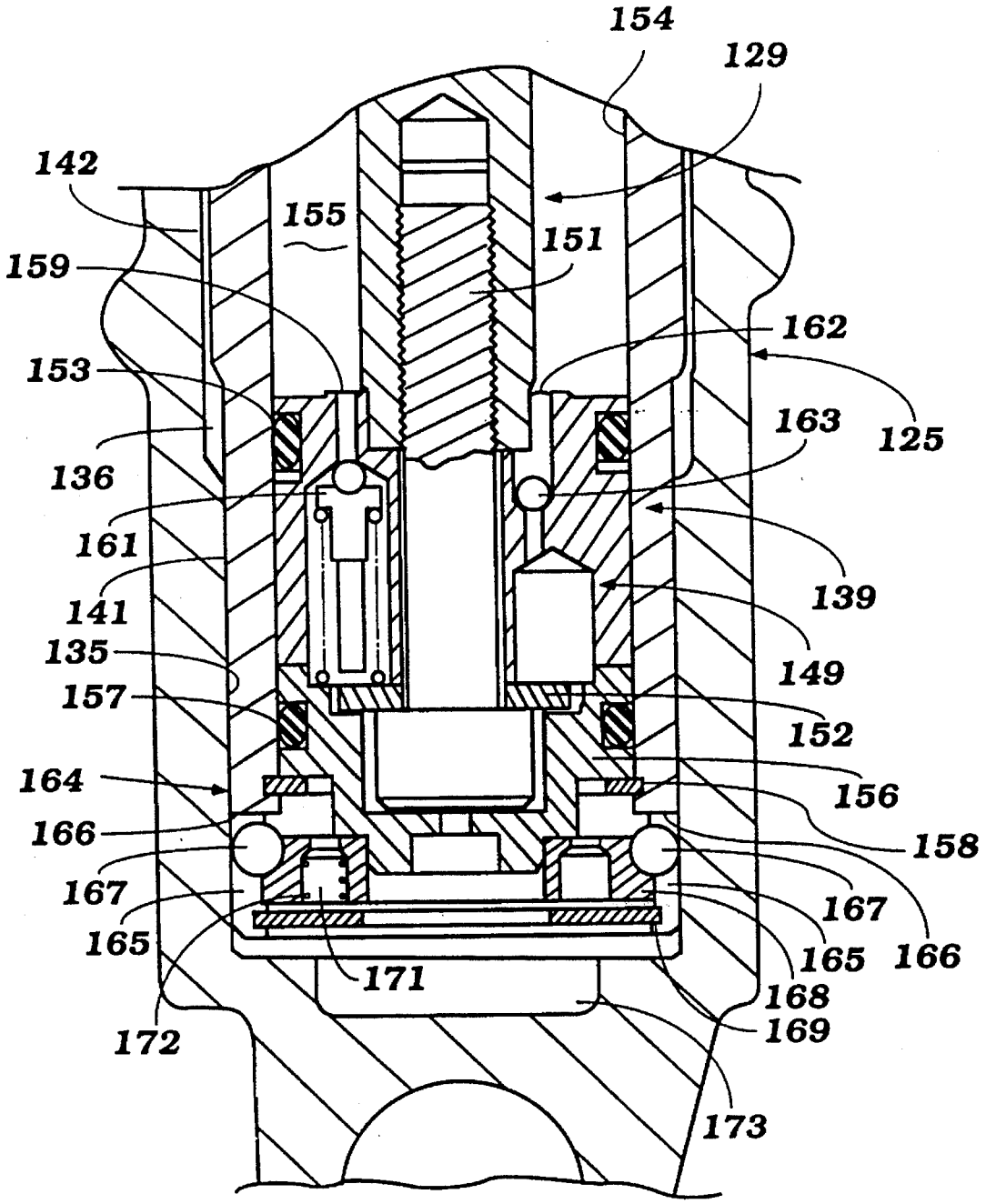

FIG. 11 is an enlarged cross-sectional view of the lower portion of the unit.

FIGS. 12–16 are views, in part similar to FIGS. 2–6, and show the embodiment of the invention in the fully trimmed down condition through movement to the fully trimmed up, tilted up condition.

DETAILED DESCRIPTION OF THE PREFERRED EMBODIMENT OF THE INVENTION

Referring now in detail to FIGS. 7–16, which illustrate a preferred embodiment of the invention, and initially to FIG. 7, an outboard motor constructed in accordance with the preferred embodiment of the invention is identified generally by the reference numeral 101. The outboard motor 101 is shown as attached to a transom 102 of an associated watercraft 103 that is shown partially and in phantom. The hydraulic tilt and trim device constructed in accordance with the embodiment of the invention is identified generally by the reference numeral 104 and is shown in more detail in FIGS. 8–16. Basically, the attachment of the hydraulic tilt and trim unit 104 to the associated watercraft 103 and its relationship with the outboard motor 101 is the same as the prior art type of devices. This has been previously noted.

Also, although the invention is described in conjunction with the outboard motor 101, it should be readily apparent that the invention is susceptible of use with other types of outboard drives, such as the outboard drive portion of an inboard/outboard drive. However, because of the nature of the invention, it has particular utility with outboard drive units of small and medium size. This does not mean, however, that the facets of the invention cannot be used with larger displacement units and it is believed that that usage will be readily obvious to those skilled in the art.

The outboard motor 101 includes a power head 105 which is comprised of a powering internal combustion engine and a surrounding protective cowling. As is typical with outboard motor practice, the engine of the power head 105 is supported so that its output shaft rotates about a vertically extending axis and drives a drive shaft that is journaled within a drive shaft housing 106. None of the internal components of the outboard motor 101 are being illustrated because it will be obvious to those skilled in the art how the invention can be employed with any conventional type of structure.

The drive shaft which extends through the drive shaft housing 106 extends into a lower unit 107 and there drives a propulsion device such as a propeller 108 through a conventional forward/neutral/reverse transmission.

A steering shaft (not shown) is affixed to the drive shaft housing 106 and is supported for steering movement within a swivel bracket 109 in a known manner. The swivel bracket 109 has a forwardly extending portion 111 that is connected by means of a pivot pin 112 to a clamping bracket 113. The clamping bracket 113 is adapted to be detachably affixed to the transom 102 in a well-known manner.

The pivotal connection 112 between the clamping bracket 113 and the swivel bracket 109 permits the outboard motor 101 to be moved through a trim adjusted range, indicated at A in FIG. 1, wherein the fully trimmed down position is shown in solid lines and the fully trimmed up position is shown in phantom lines. In addition, the outboard motor 101 may be swung through a remaining arc B to a tilted up out-of-the-water position about the pivot pin 112, as also shown in a phantom line view. The hydraulic tilt and trim device 104 operates to effect these movements and other movements, as will become apparent.

The device 104 will now be described by additional reference to FIGS. 8 and 9 in addition to FIG. 7 wherein the overall exterior construction is shown. It will be seen that the clamping bracket 113 actually comprises a pair of spaced-apart side portions 114 that are mounted on the rear of the transom with the swivel bracket 109 being interposed between them. The hydraulic tilt and trim device 104 is nested between the bracket 114 so as to provide a compact assembly.

The device 104 is comprised of the actual hydraulic motor assembly, indicated generally by the reference numeral 115, which is disposed adjacent to and which forms an integral part with the powering assembly 116 therefor. The powering assembly 116 includes at the upper end a reversible electric motor 117. A reversible hydraulic pump 118 is disposed below the motor 117 and has a rotor which is driven by it. A fluid reservoir 119 is disposed beneath the pump 118 and contains fluid for the system. In addition, a suitable valve assembly may be incorporated within the pump 118 and reservoir 119 so as to provide the normal pressure relief functions and so forth.

In addition, the pump 118 is provided with a pair of outlet ports 121 and 122 that communicate with inlet ports 123 and 124 formed in the hydraulic tilt and trim device 104. It should be noted that the outer housings of the units 104 and 118 may be common or they may comprise separate pieces that are affixed to each other. However, by having interfitting ports such as the ports 112, 123 and 122, 124, the necessity for providing external conduits is avoided and the construction is more compact.

Continuing to refer only to the external construction, the hydraulic motor 115 includes a cylinder housing 125 having a trunnion portion 126 with a bore 127 so as to receive a pin 128 for providing a pivotal connection to the clamping bracket 113, and specifically to the side plates 114 thereof. In addition, a piston rod 129 has a trunnion 131 with a bore 132. This piston rod bore receives a further pivot pin 133 that provides a pivotal connection to a bore 134 formed in a portion of the swivel bracket 109 so as to interpose the hydraulic unit 115 therebetween for the tilt and trim movement, which will now be described by reference primarily to FIGS. 10–16, although certain of the components also appear in FIG. 8 so as to permit those skilled in the art to understand the principles of the invention and the utility of the overall construction.

Like the prior art type of constructions, the outer cylinder 125 is provided with a bore, but in this instance this bore is comprised of three portions, each having a different diameter. These comprise a lower portion 135 which has the smallest diameter and is formed adjacent the blind end of the cylinder 125. Above the bore 135 is an intermediate, larger diameter bore 136. At the upper end of the bore 136 there is provided a further, still larger diameter bore 137 which is closed at its upper end by an end closure and gland assembly 138.

A trim cylinder, indicated generally by the reference numeral 139, is slidably supported within these three bores 135, 136, and 137 and is formed itself with a lower, smaller diameter portion 141 which is contained primarily within the bore 135 but which extends partially in all positions into the bore 136. Above the cylindrical portion 141 there is provided a further portion 142 which has an outer diameter that is complementary to the outer cylinder bore 136 and which is received in this bore and also in the bore 137 in all of its positions.

The upper end of the trim cylinder 139 is provided with a sealing ring portion 143 that is affixed rigidly to it between a shoulder 144 and an end closure, gland assembly 145. The sealing ring 143 has inner and outer grooves that receive a pair of O-rings 146 for sealing the trim cylinder 139 and the outer cylinder 125 so as to define a first upper fluid chamber 147 that is in communication with the port 123 through an internal passage which terminates adjacent the end closure and gland 138 and which does not appear in the figures.

A position responsive valve, indicated generally by the reference numeral 148, is provided in the end closure and gland 145 for a reason which will be described and which is basically the same as the prior art construction.

It should be noted that since the trim cylinder 139 provides its fluid seal with the upper outer cylinder bore portion 137, close tolerances can be easily maintained because the bore portion 137 is adjacent the end closed by the gland 138. Also, a large diameter may be used for the bore 137 and sealing ring 143 in the area above the pump 118 and reservoir 119 so as to permit a very compact assembly and one which can be easily nested between the clamping bracket side plate 114. This construction is evident from FIG. 8, wherein it is seen that the electric drive motor 117 has a lesser transverse dimension than the pump housing 118 and reservoir 119. Thus, the advantages of this facet of the construction should be readily apparent to those skilled in the art.

Referring now primarily to FIG. 11, a piston, indicated generally by the reference numeral 149, is affixed to the lower end of the piston rod 129 by means including a threaded fastener 151 which is engaged with a retainer plate 152 which, in turn, holds the body of the piston 149 in place. The piston 149 carries a seal 153, which is in sealing engagement with an internal bore 154 of the trim cylinder 139. This thus forms a first fluid chamber 155 between the piston 149 and the end closure and gland 145.

A floating piston 156 is positioned within the trim piston cylinder bore 145 and carries a seal 157 for providing sealing engagement therewith. The floating piston 156 may move axially within the trim cylinder bore 145, but its lowermost position is limited by a snap ring 158 that is received in a groove formed at the lower end of the trim cylinder 139. Hence, the floating piston 156 forms a further fluid chamber between the underside of the piston 149 within the trim cylinder bore 154.

A shock absorber passage 159 extends through the piston 149, and a pressure responsive absorber valve 161 permits restricted flow from the chamber 155 to the chamber formed between the piston 149 and the floating piston 157 so as to permit the outboard motor 101 to pop up when an underwater obstacle is struck. When the underwater obstacle is cleared, the outboard motor 101 may again return to its trim adjusted position by fluid flow from the area between the piston 149 and the floating piston 156 through a let-down passage 162 formed in the piston 149. The flow through passage 162 is controlled by a light absorber check valve 163.

A latching mechanism, indicated generally by the reference numeral 164 and shown in most detail in FIG. 11, is provided at the lower end of the trim cylinder 139 for latching the trim cylinder in its fully trimmed up position so as to avoid the problems of the prior art type of constructions. To this end, the lower ends of the trim cylinder 139 are provided with a number of circumferentially spaced elongated slots 165 which terminate at their upper ends in shoulders 166. Detent locking balls 167 are received within each of these slots 167 and are normally biased radially outwardly by a biasing plate 168. The biasing plate 168 is caged within the lower end of the trim cylinder 139 by means of a snap ring 169 received within a groove therein.

The biasing plate 168 is provided with a number of axially extending bores 171 that receive coil compressing springs 172 that are engaged with the snap ring 169 and normally urge the biasing plate 168 upwardly and the detent balls 167 outwardly. Their latching function cooperates with the lower end of the bore portion 136 of the outer cylinder 125, as will be described shortly by reference to FIGS. 12–16.

A fluid chamber 173 is formed by the outer cylinder bore 135 below the trim piston 139 and which can communicate with the underside of the floating piston 156 through the opening in the retaining ring 169. It has been noted that there is provided the position responsive valve 148 in the end closure and gland 145 which communicates the chamber 146 with the chamber 155. The valve 148 controls the flow through a passage 174 that is formed in the gland 145. This valve includes a projecting portion 175 that will contact the enclosure 138 when the trim cylinder 139 is in its fully trimmed up condition.

The operation of the unit 104 and specifically the hydraulic fluid motor portion 115 thereof will now be described by reference to FIGS. 12–16 with these figures corresponding to the same positions as shown in the prior art arrangement of FIGS. 2–6.

Figures 12, 13, 14, 15, 16:
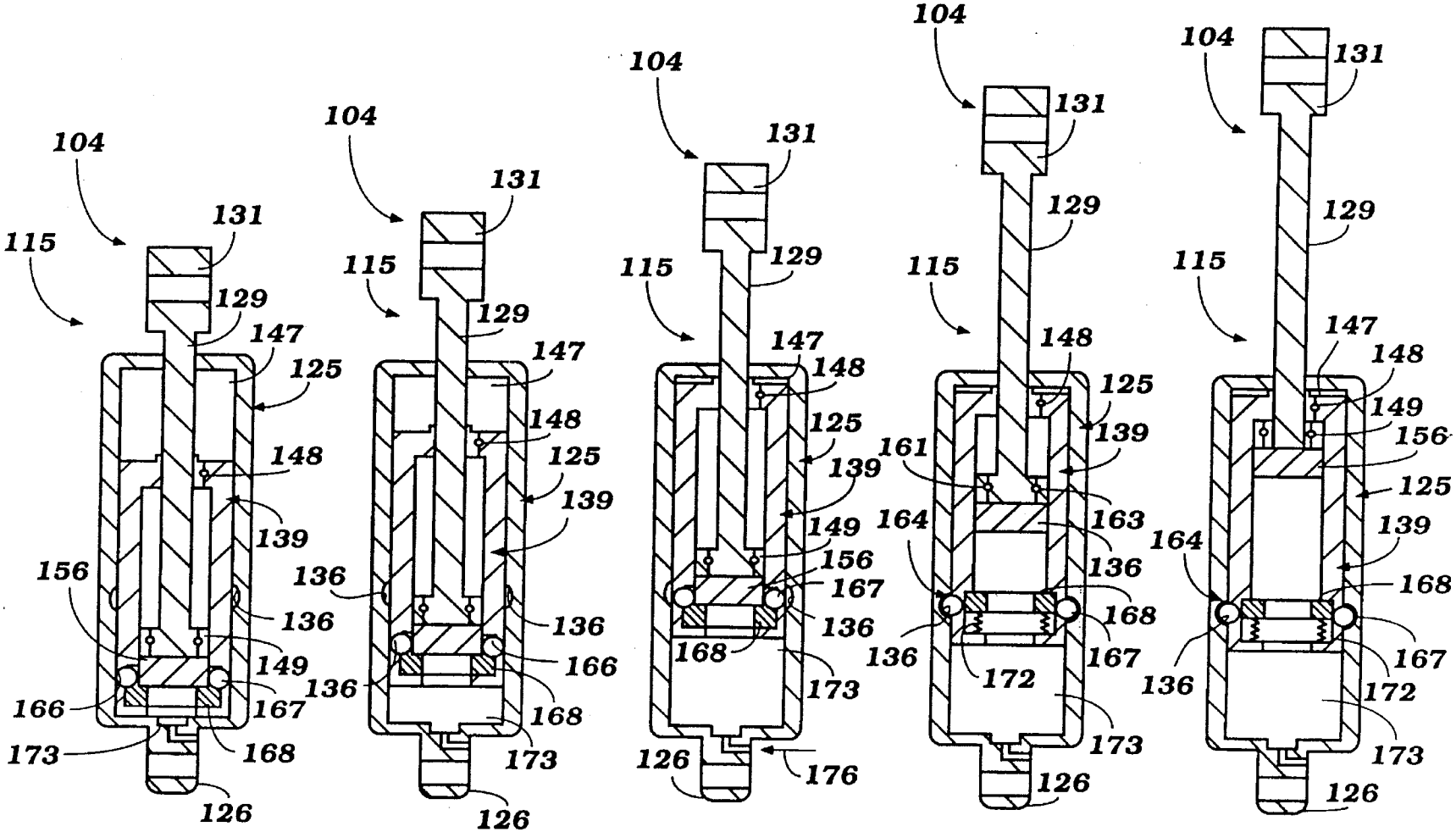

FIG. 12 shows the fully trimmed down condition which corresponds to the solid line view of FIG. 7. If it is desired to trim the outboard motor 101 up through the range A, as shown in FIG. 7, the system is pressurized so as to introduce fluid under pressure to the chamber 173 beneath the trim cylinder 139 and vent the upper chamber 147 back to the return side of the pump. Since the piston rod 129 extends through the chamber 147, more fluid will be required to cause trim-up movement than is displaced from the chamber 147, and this made-up fluid is made up from the reservoir 119.

When the chamber 173 is pressurized, the pressure will act on the floating piston 156 and urge it upwardly along with the trim cylinder 141. As with the prior art type of arrangements, the effective fluid area is the area of the trim cylinder, but in this case, since the seal between the trim cylinder is disposed on the sealing ring 143, a larger diameter effective area is provided then with the prior art type of constructions. That is, the effective area of the trim cylinder 139 is not the area displaced by either the cylindrical portions 141 or 142, but actually the area of the ring 143. This does not appear in FIGS. 12–14, but is evident from FIG. 10.

This upward movement can continue throughout the trim range A until the trim cylinder 139 reaches its uppermost position. At the time that this happens, the detent balls 167, which have been engaged with the cylinder bore 135, will move into the area of the cylinder bore 136. The balls 167 will not be moved to their engaged position at this time, however, since the ring 165 will still be retained in position by a projecting portion of the floating piston 156, as shown in FIG. 11, and hence the balls are shown retracted in FIG. 14. That is, the locking of the trim cylinder 139 in position does not occur immediately when the trim cylinder 139 moves to the position at the end of the trim-up adjustment.

Figure 4:
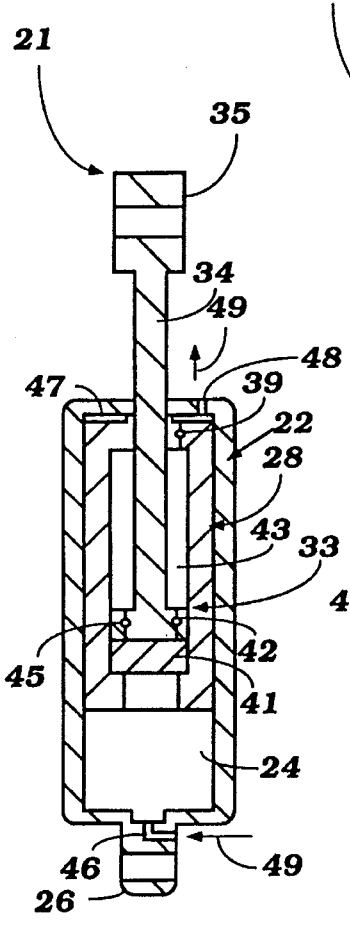
Figure 4 Prior Art
Figure 3:
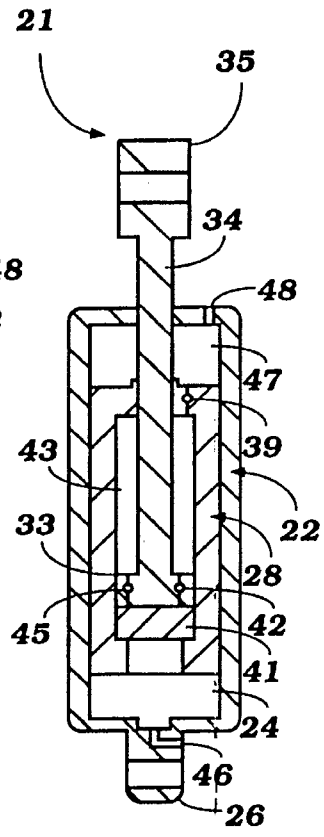
Figure 3 Prior Art
Figure 2:
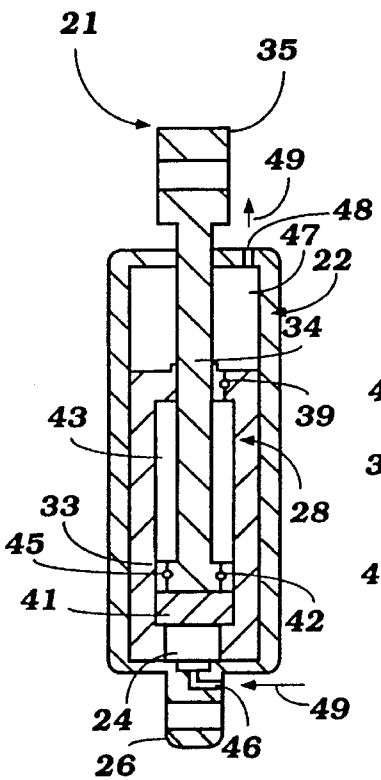
Figure 2 Prior Art

Once the outboard motor 101 has been fully trimmed up to the end of its range, as shown in the lower phantom line view of FIG. 7, if the operator desires to achieve tilt up, then the chamber 173 is again pressurized or is continued to be pressurized, as shown by the arrow 176 in FIG. 4. When this occurs, the floating piston 156 will be urged upwardly away from the snap ring 158 (FIG. 11). When this occurs, the springs 172 can expand and move the plate 168 upwardly so as to urge the detent balls 167 outwardly into engagement with the larger diameter bore portion 136, which is depicted in FIGS. 12–16 as a detent recess. Although it is possible to form this as merely a detent recess, for machining simplicity the portion 136 actually is a larger diameter bore, as shown accurately in FIGS. 10 and 11 and only schematically in FIGS. 12–16.

Figure 6:
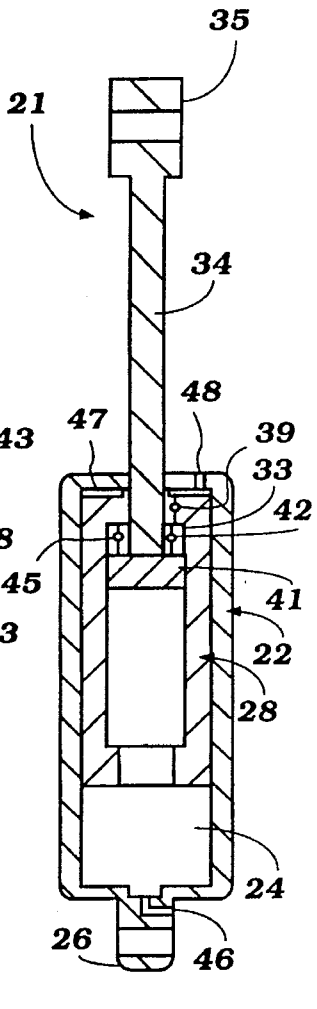
Figure 6 Prior Art
FIGS. 2–6 are cross-sectional views, in part similar to FIG. 1, and show the fully trimmed down, tilted down position to the fully trimmed up, tilted up position.
Figure 5:
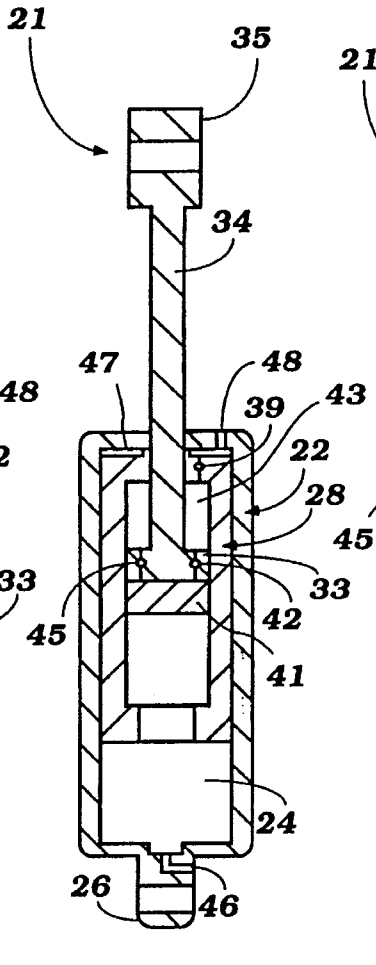
Figure 5 Prior Art

The floating piston 156 and piston 149 may then move upwardly because the position responsive valve 148 will have been opened by the contact of the projection 175 with the enclosure 138, and fluid may then be displaced from the chamber 155 to the chamber 137 and out the return conduit aforedescribed. This movement can continue until the fully tilted up position, as shown in FIG. 6. In this position, the detent balls 167 will act to lock the trim cylinder 139 against downward movement, even if there is no fluid pressure existent in the chamber 173. Thus, the system cannot float downwardly due to the locking of the trim cylinder in position.

When it is desired to effect tilt down, the chamber 147 is pressurized, and this will cause the piston 149 and floating piston 156 to move downwardly from the position shown in FIG. 16 to the position shown in FIG. 15 and finally to the position shown in FIG. 14. When the position of FIG. 14 is reached, the plate 168 will be moved downwardly and the floating piston 156 will effect this movement, compressing the springs 172. Thus, the detent balls 167 may be cammed out of engagement with the bore portion 136 to move into the smaller diameter bore 135 so as to adjust the trim position as desired.

From the foregoing description, it should be readily apparent that the described construction provides not only a very compact assembly, but also one in which the tilted up position can be maintained without the provision of an external mechanically actuated lock.

It is to be understood that the foregoing description is that of a preferred embodiment of the invention and that various changes and modifications may be made without departing from the spirit and scope of the invention as defined by the appended claims.

We claim:

1. A telescopic tilt and trim hydraulic cylinder arrangement for an outboard drive and watercraft comprising an outer cylinder element adapted to be affixed to one of said outboard drive and said watercraft and defining a first internal cavity, a trim cylinder received and slidably supported within said first internal cavity and defining a second internal cavity, a tilt piston slidably received in said second internal cavity, a piston rod affixed to said tilt piston and extending beyond said internal cavities for attachment to the other of said outboard drive and said watercraft, a closure member at the end of said trim cylinder through which said piston rod extends and which forms a seal around each piston rod for closing one end of said second internal cavity on one side of said tilt piston, means for selectively pressurizing said cavities for effecting reciprocal movement of said trim cylinder and said tilt piston for effecting trim adjustment of said outboard drive and for effecting relative movement of said trim piston to said trim cylinder for effecting tilt up movement of said outboard drive, said outer cylinder first internal cavity being defined by a blind bore extending therethrough and closed at one end by an end closure through which said piston rod extends, and means for providing a seal between the end of said trim cylinder disposed adjacent said end closure and said outer cylinder element.

2. A telescopic tilt and trim hydraulic cylinder arrangement as in claim 1, further including means for forming a closure at the end of the trim cylinder opposite to the end closed by the closure member.

3. A telescopic tilt and trim hydraulic cylinder arrangement as in claim 2, wherein the means for forming the closure at the other end of the trim cylinder comprises a floating piston slidably supported within said tilt cylinder.

4. A telescopic tilt and trim hydraulic cylinder arrangement as in claim 3, wherein the cavity of the outer cylinder is comprised of a first larger diameter portion wherein the means for sealing the one end of the trim cylinder to the outer cylinder is positioned, a second smaller diameter portion through which the majority of the length of the tilt cylinder extends, and a third smallest diameter portion adjacent the blind end of said cavity into which said tilt cylinder extends in some positions of the outboard drive.

5. A telescopic tilt and trim hydraulic cylinder arrangement as in claim 4, further including a position responsive valve in the enclosure for the tilt cylinder for providing communication between the upper outer cylinder cavity and the area of the tilt cylinder between its end closure and the tilt piston when the trim cylinder is in its fully trimmed up position.

6. A telescopic tilt and trim hydraulic cylinder arrangement as in claim 4, wherein the tilt piston is provided with a shock absorber valve for permitting flow from one side of said tilt piston to the other side of said tilt piston when an underwater obstacle is struck and a return valve for permitting flow in the opposite direction once the underwater obstacle is cleared.

7. A telescopic tilt and trim hydraulic cylinder arrangement as in claim 6, further including a position responsive valve in the enclosure for the tilt cylinder for providing communication between the upper outer cylinder cavity and the area of the tilt cylinder between its end closure and the tilt piston when the trim cylinder is in its fully trimmed up position.

8. A telescopic tilt and trim hydraulic cylinder arrangement as in claim 7, further including releasable latch means for retaining said trim cylinder in its fully trimmed up position.

9. A telescopic tilt and trim hydraulic cylinder arrangement as in claim 8, wherein the releasable latch means operates upon a shoulder formed between the smallest diameter portion of the cavity and the next smallest diameter portion.

10. A telescopic tilt and trim hydraulic cylinder arrangement as in claim 9, wherein the latch means comprises a plurality of detent balls urged radially outwardly by a latching member.

11. A telescopic tilt and trim hydraulic cylinder arrangement as in claim 10, wherein the floating piston has a portion that retains the latching member in an unlatched position until the floating piston is actuated for effecting tilt-up movement of the outboard drive.

12. A telescopic tilt and trim hydraulic cylinder arrangement as in claim 11, wherein the piston rod is affixed to the outboard drive and the outer cylinder is affixed to the watercraft.

13. A telescopic tilt and trim hydraulic cylinder arrangement for an outboard drive and watercraft comprising an outer cylinder element adapted to be affixed to one of said outboard drive and said watercraft and defining a first internal cavity, a trim cylinder received and slidably supported within said first internal cavity and defining a second internal cavity, a tilt piston slidably received in said second internal cavity, a piston rod affixed to said tilt piston and extending beyond said internal cavities for attachment to the other of said outboard drive and said watercraft, means for selectively pressurizing said cavity for effecting reciprocal movement of said trim cylinder and said tilt piston for effecting trim adjustment of said outboard drive and for effecting relative movement of said tilt piston to said trim cylinder for effecting tilt up movement of said outboard drive, and latching means for effecting releasable latching of said trim cylinder in a predetermined position for effecting movement of said tilt piston without movement of said trim cylinder until said latching means is released.

14. A telescopic tilt and trim hydraulic cylinder arrangement as in claim 13 wherein the latching means for effecting releasable latching of the trim cylinder latches the trim cylinder in one of its extreme positions.

15. A telescopic tilt and trim hydraulic cylinder arrangement as in claim 14 wherein the one extreme position is the position corresponding to the fully trimmed up position.

16. A telescopic tilt and trim hydraulic cylinder arrangement as in claim 15 wherein the latching means for effecting releasable latching is not latched in its latched position until fluid pressure for effecting tilt-up operation is applied to the tilt piston.

17. A telescopic tilt and trim hydraulic cylinder arrangement as in claim 13 wherein the means for effecting releasable latching comprises a releasable latch.

18. A telescopic tilt and trim hydraulic cylinder arrangement as in claim 17, wherein the latching cavity of the outer cylinder is comprised of a first larger diameter portion and a second smaller diameter portion forming a shoulder with which the releasable latch cooperates.

19. A telescopic tilt and trim hydraulic cylinder arrangement as in claim 18, wherein the latch comprises a plurality of detent balls urged radially outwardly by a latching member.

20. A telescopic tilt and trim hydraulic cylinder arrangement as in claim 19, further including a floating piston received in said second internal cavity below said tilt piston, said floating piston having a portion that retains the latch in an unlatched position until the floating piston is actuated for effecting tilt-up movement of the outboard drive.

21. A telescopic tilt and trim hydraulic cylinder arrangement as in claim 20, further including a position responsive valve in the enclosure for the tilt cylinder for providing communication between the upper outer cylinder cavity and the area of the tilt cylinder between its end closure and the tilt piston when the trim cylinder is in its fully trimmed up position.

22. A telescopic tilt and trim hydraulic cylinder arrangement as in claim 20, wherein the tilt piston is provided with a shock absorber valve for permitting flow from one side of said tilt piston to the other side of said tilt piston when an underwater obstacle is struck and a return valve for permitting flow in the opposite direction once the underwater obstacle is cleared.

23. A telescopic tilt and trim hydraulic cylinder arrangement as in claim 22, further including a position responsive valve in the enclosure for the tilt cylinder for providing communication between the upper outer cylinder cavity and the area of the tilt cylinder between its end closure and the tilt piston when the trim cylinder is in its fully trimmed up position.

* * * * *